US005601103A

United States Patent [19]

Dubinsky

[11] Patent Number: 5,601,103

[45] Date of Patent: Feb. 11, 1997

[54] UMBRELLA HAVING PARTIAL TOP CANOPY AND UNDERSIDE CANOPY CONNECTED WITH CANOPY RIB SLEEVES TO FORM WIND VENT AND STABILIZE THE RIBS

[76] Inventor: Emanuel Dubinsky, 3 Cross Ridge Rd, Chappaqua, N.Y. 10514

[21] Appl. No.: 538,590

[22] Filed: Oct. 3, 1995

[51] Int. Cl.[6] ..... A45B 25/22

[52] U.S. Cl. ..... 135/33.7; 135/334; 135/33.2; 135/15.1; 135/33.41

[58] Field of Search ..... 135/98, 15.1, 33.2, 135/33.4, 33.41, 33.7

[56] References Cited

U.S. PATENT DOCUMENTS

| | | | |
|---|---|---|---|
| D. 162,617 | 3/1951 | Benivegna | 135/33.7 X |
| 3,885,582 | 5/1975 | Kawalski | 135/33.7 |
| 4,865,063 | 9/1989 | Williams | 135/33.7 |
| 5,078,166 | 1/1992 | Lee | 135/33.7 |
| 5,226,438 | 7/1993 | Dubinsky | 135/33.4 |
| 5,368,055 | 11/1994 | Johnson et al. | 135/33.7 |
| 5,398,710 | 3/1995 | Steiner | 135/33.2 X |

FOREIGN PATENT DOCUMENTS

| | | | |
|---|---|---|---|
| 106457 | 5/1927 | Belgium | 135/33.7 |
| 692497 | 8/1930 | France | 135/33.7 |
| 928634 | 12/1947 | France | 135/33.7 |

*Primary Examiner*—Wynn E. Wood
*Attorney, Agent, or Firm*—Philip Young, Esq.

[57] ABSTRACT

A garden umbrella with a partial top canopy covering the central area of the umbrella and located on the upper side of the canopy ribs, and an underside outer canopy secured to the underside of the canopy ribs and covering at least the outer ring portion of the canopy ribs not covered by such partial top canopy. The underside outer canopy has canopy rib sleeves formed on its top side and adapted for receiving therein the middle and end tip portions of the canopy ribs. The partial top canopy is secured at its outer ends to the upper side of the canopy ribs and the canopy sleeves such that a deep vent is formed between the partial top canopy and the underside outer canopy for venting wind through the space between the two canopies. In one embodiment, the underside outer canopy has a general ring shape with an opening in the center for further venting of wind and updrafts through the center of the umbrella. Also, the connection of the partial top canopy and the underside canopy respectively on top of and under the canopy ribs and the rib sleeves provides a double canopy link extending around the unbrella thereby stabilizing the ribs from unwanted shifting from side to side in response to wind pressures.

10 Claims, 4 Drawing Sheets

FIG. 1
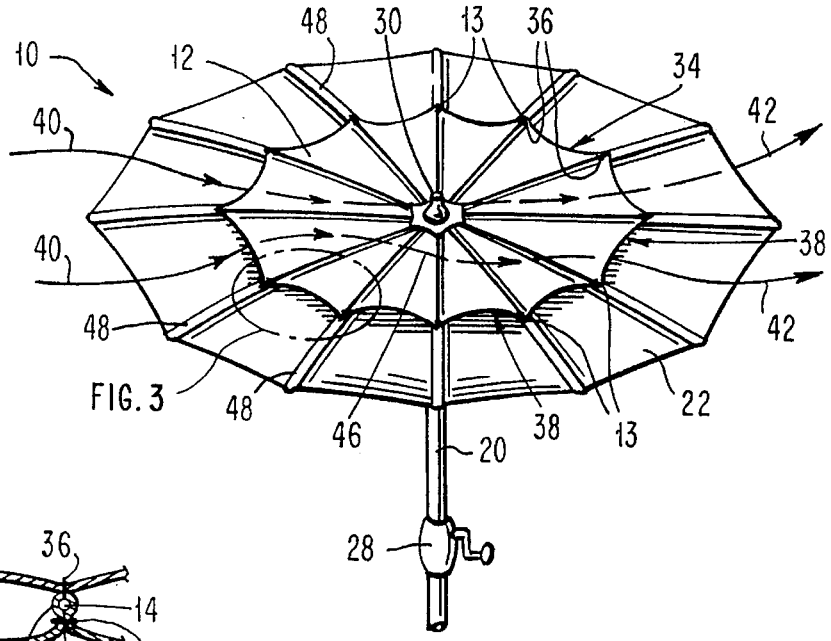
FIG. 3
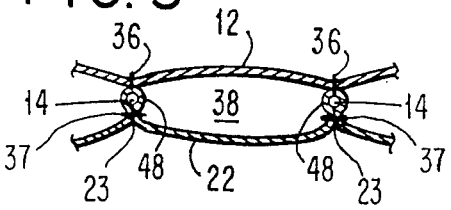
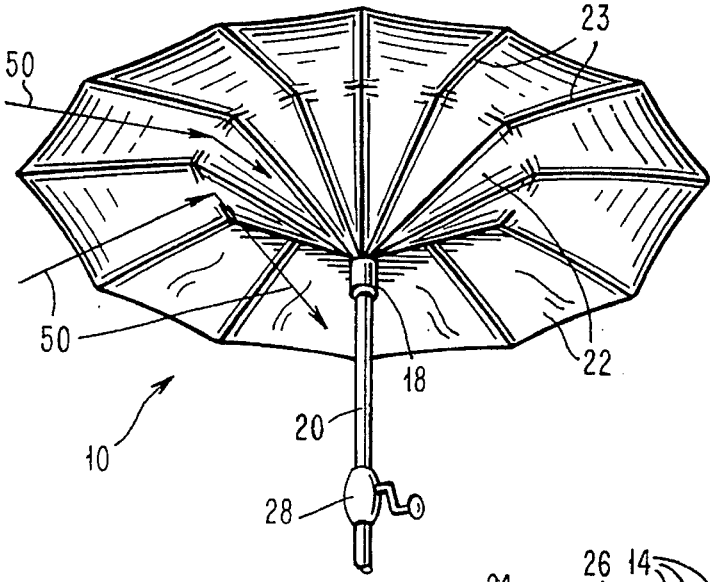
FIG. 2
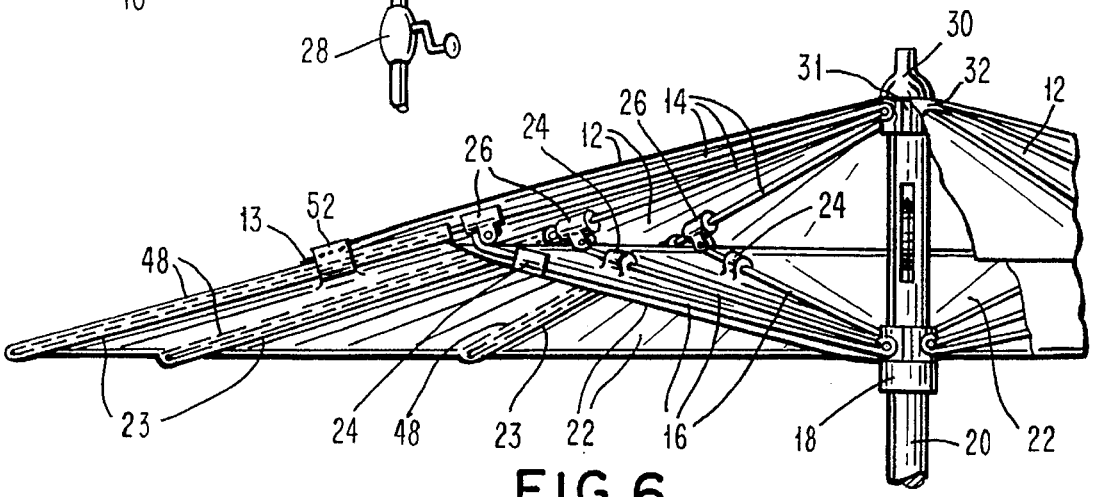
FIG. 6

FIG. 4
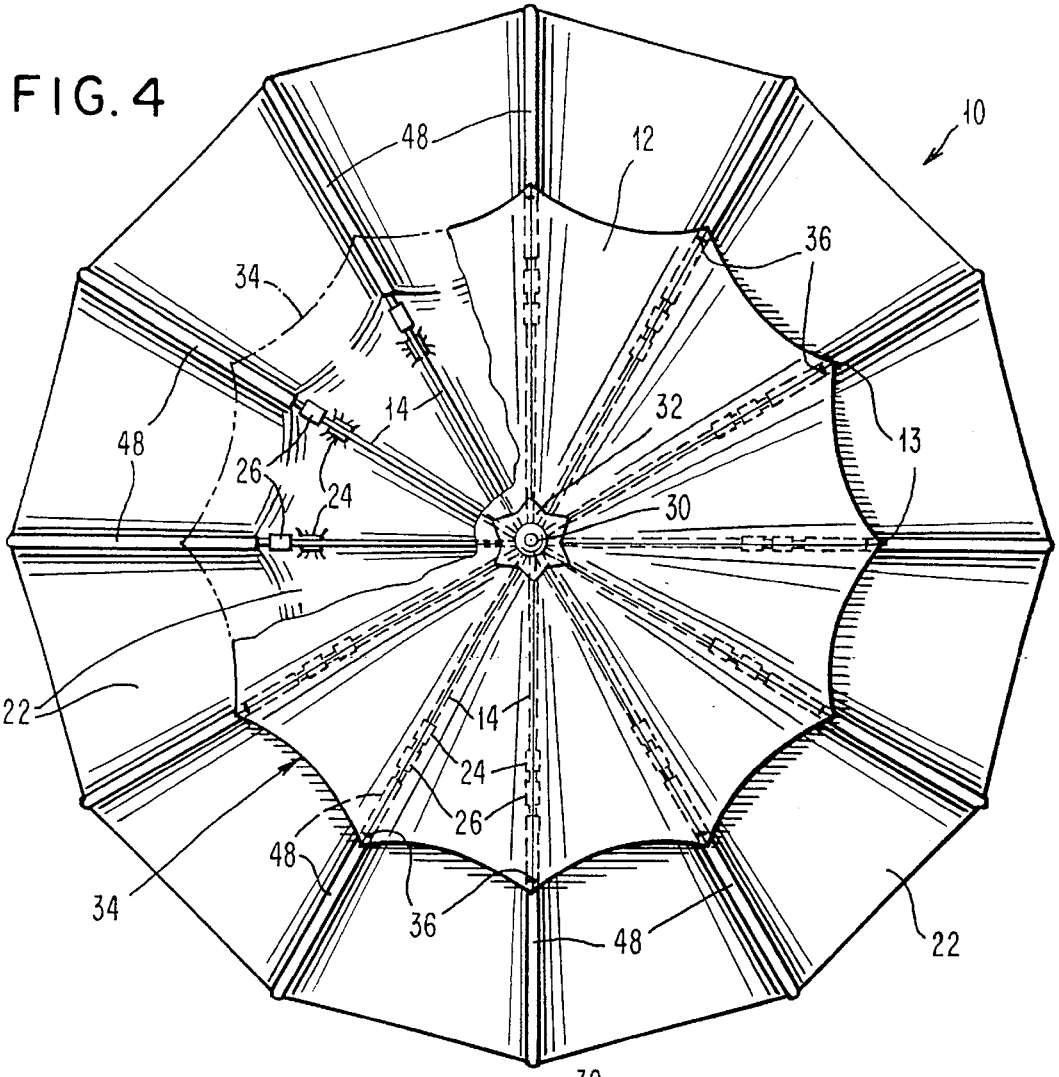
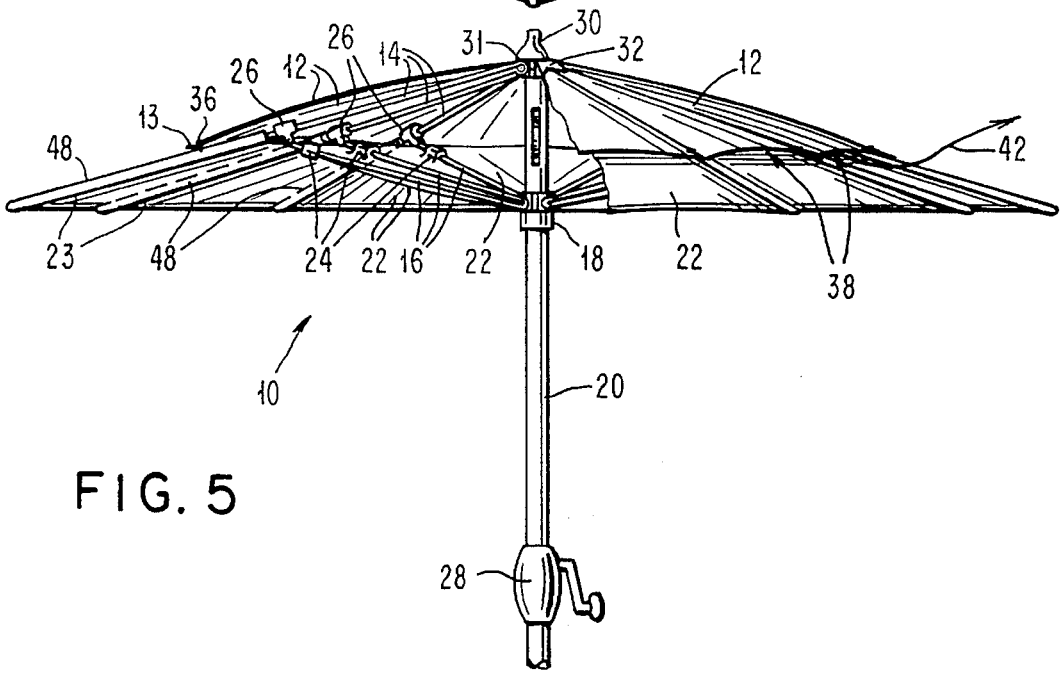
FIG. 5

UMBRELLA HAVING PARTIAL TOP CANOPY AND UNDERSIDE CANOPY CONNECTED WITH CANOPY RIB SLEEVES TO FORM WIND VENT AND STABILIZE THE RIBS

BACKGROUND OF THE INVENTION

1. Field of The Invention

The present invention relates to umbrellas and, more particularly, to umbrellas of the generally large size used outdoors in the patio and garden and commonly referred to as "garden umbrellas".

2. Background Art

The conventional umbrellas and, more particularly, the larger sized patio and garden umbrellas generally are made with a rib support system attached to a means for extending and retracting the ribs to respectively open and close the umbrella. The umbrella has a canopy that is sits on top of the ribs and is attached to the ribs at the rib end tips and at one or more points along the rib length. One problem with umbrellas is that the wind can lift the underside of the canopy and force it into an inside out configuration, often destroying the canopy and the rib support structure. The wind causes flexing of the ribs and mechanical stress thereto, which may result in bending and snapping of the ribs and rib support system.

To overcome the problems of wind caused upon the umbrella and to release the air pressure from below the conventional umbrellas, various forms of holes, openings and vents have been provided in the umbrella cover material. One type of wind vent umbrella is disclosed by John David Farley in U.S. Pat. No. 3,456,661 wherein the normal umbrella covering is open at the top central portion of the umbrella and a top canopy tier is mounted above the opening to provide vents for the air rising from below the canopy. The top canopy tier is required to cover the opening and prevent the rain from passing down through the vents and into the central umbrella covering and onto the umbrella user. In this type of umbrella, the partial umbrella covering, with its central opening, may result in a less stable and less rigid umbrella structure due to the frame support ribs being only partially tied together and covered by the main umbrella covering.

In U.S. Pat. No. 5,226,438 issued on Jul. 13, 1997 to Emanuel Dubinsky, the inventor herein, there is provided a garden umbrella having both a top canopy and a lining attached to the underside of the umbrella ribs, including the stretcher rib structure at the central portion of the umbrella, for deflecting wind and reducing the lift effect of wind against the bottom of the umbrella.

SUMMARY OF THE INVENTION

In view of the foregoing, it is an object of the present invention to provide an umbrella which is stable and has high resistance to wind. It is another object to provide an umbrella having means for stabilizing the ribs against relative movement, while at the same time providing a deep vent for wind. It is still another object to provide an umbrella canopy cover designed to strengthen and reinforce the rib structure against the effects of wind.

These, and other objects, are achieved by the present invention which provides a garden umbrella with a partial top canopy covering the central area of the umbrella and located on the upper side of the canopy ribs, and an underside outer canopy secured to the underside of the canopy ribs and covering at least the outer ring portion of the canopy ribs not covered by such partial top canopy. The underside outer canopy has canopy rib sleeves formed on its top side along the seams of the canopy fabric panels of such outer canopy. The canopy rib sleeves are adapted for receiving therein the middle and end tip portions of the canopy ribs, thereby securing the underside outer canopy to the underside of the canopy ribs. The partial top canopy is secured at its outer ends to the upper side of the canopy ribs and the canopy sleeves such that a deep air passage, or vent, is formed between the partial top canopy and the underside outer canopy for venting wind through such passage between the two canopies. Also, the structural combination of the partial top canopy and the underside canopy respectively on top of and under the canopy ribs, together with the rib sleeves provides a double canopy link extending around the unbrella, thereby stabilizing the ribs from unwanted shifting from side to side in response to wind pressures.

In a first embodiment, the underside outer canopy covers the bottom of both the canopy ribs, at the outer ring of the umbrella, and stretcher ribs at the center of the umbrella, with wind venting provided in the vent space formed between the partial top canopy and the underside outer canopy. In a second embodiment, the underside outer canopy has a general ring shape with an opening in the center for further venting of wind and updrafts through the center of the umbrella.

BRIEF DESCRIPTION OF THE DRAWINGS

FIG. 1 is a perspective view of an overall patio umbrella taken from the top side of the umbrella, showing the partial top canopy and the underside main canopy, illustrative of the present invention;

FIG. 2 is a perspective view taken from the bottom side of the umbrella;

FIG. 3 is a cutaway view of a portion of the umbrella taken from FIG. 1 as indicated, showing the special stitch arrangement of the partial top canopy at the top of the ribs and the stitching of the underside main canopy at the bottom of the ribs to form the vent openings defined by the passage between the adjacent ribs and the top canopy and the underside main canopy;

FIG. 4 is a top view of the umbrella with a partial exposed center portion to show the ribs, clips and rib connectors in broken line detail, and a cutaway section of the top canopy;

FIG. 5 is a side view, taken partially in section to show the relative positions of the partial top canopy and the underside main canopy above and below the ribs and the rib sleeves;

FIG. 6 is a side view, taken partially in section, similar to FIG. 5, showing further details of the rib sleeves, and the special seams in the underside canopy;

DESCRIPTION OF THE PREFERRED EMBODIMENTS

Figure 7:
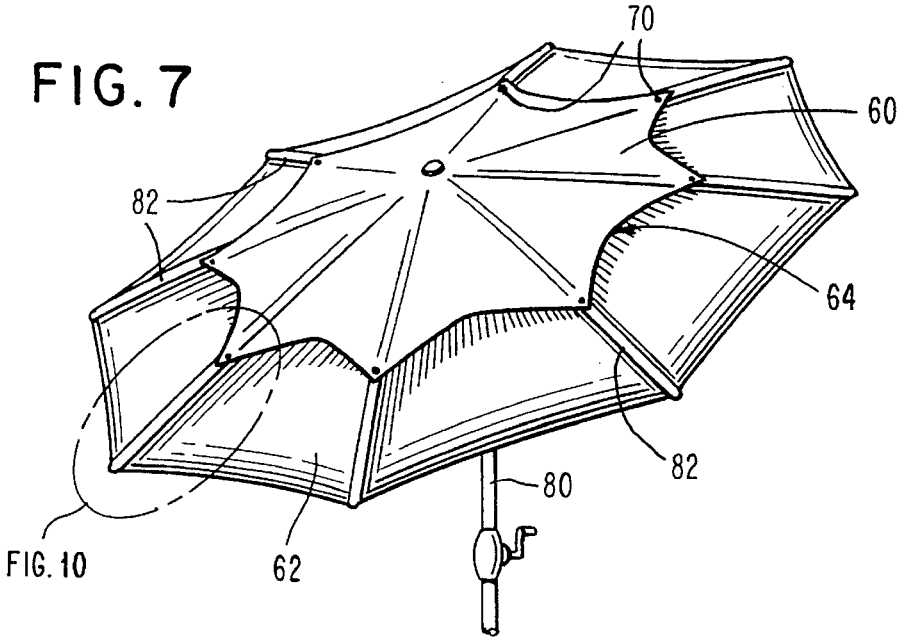
FIG. 7 is a top perspective view of an umbrella, illustrative of another embodiment of the present invention.

Referring FIGS. 1 and 2, there are respectively shown the perspective top and bottom views of a garden umbrella 10 having a partial top canopy 12 which extends from the top portion 30 of umbrella pole 20 down to a canopy tip 13 where each canopy tip 13 is secured at the top of canopy support ribs 14 by clips 52, shown in FIG. 6, or by stitches 36, shown in FIG. 5, as will be described in detail below. An underside main canopy extends along the bottom of the umbrella rib support system, according to the embodiment shown in FIGS. 1–6. The rib support system includes the canopy support ribs 14 pivotally connected from a top ribholder 31 which is fixed near the top 30 of the pole 20. The canopy ribs 14 extend to the outer ends of the underside main canopy 22, with the outer portion of the ribs 14 fitting into sleeves 48 sewn into the canopy at each seam defining the line where each adjacent panel of the canopy 48 is sewn together. In the umbrella embodiment shown in FIGS. 1–6, the underside main canopy 22 comprises 12 panels of canopy fabric material which are joined together along seams 23 by stitches 37, shown in FIG. 3. Such material of canopy 22 forms the rib sleeves 48 for receiving therein the outer ends of ribs 14 in such fashion that the underside main canopy 22 is secured to and extends along the bottom of the ribs 14 when the umbrella is in its open position. FIG. 3 shows the area where the partial top canopy 12 is attached at its tip 13 by stitches 36 to the rib sleeves 48 at the top of the support ribs 14 held therein, while the underside main canopy 22 is secured by stitches 37 at the bottom of the rib sleeves 48 and such support ribs 14. This rib, sleeve and attachment of the partial top canopy 12 and the underside main canopy 22, respectively above and below the support ribs 14 at the rib sleeves 48, forms a passage, or openings 38 to assure the adequate venting of air, indicated in FIG. 1 by arrows 40 and 42, respectively into and out of such passages 38, and by broken line arrows passing between the canopies 12 and 22. The well defined passages 38 are formed with substantial height provided by the height of the stretcher ribs 16, generally ⅝ inches to ¾ inches high for the wooden ribbed "Market Umbrella" and 3/16 inch for the metal rib or "wire frame" umbrella, and the rib sleeves 48 such that the passages 38 are constantly open to permit adequate, deep venting of wind over 360 degrees of the umbrella. This avoids the disadvantages of some prior art wind vent umbrellas wherein the passages become at least partially blocked by the canopy material overhanging and flapping over the passage.

In addition, the structural integrity of the umbrella is enhanced by the combination of the partial top canopy 12, the underside main canopy 22 and the rib sleeves 48 in the form of a double or tandem canopy link between adjacent ribs and extending 360 degrees around the entire umbrella. This arrangement secures the ribs in tandem fashion and eliminates or minimizes any significant mechanical action of the ribs shifting from side to side in response to winds. The canopy materials can be made of a strong support material, such as cotton, vinyl, acrylic, polyester, and synthetic stitch bonded fabrics that are supple and pliable in nature.

Stretcher ribs 14 are pivotally connected between a ribholder runner notch 18 and a central portion of ribs 14 in conventional manner by rib connectors 26 shown in FIGS. 4, 5 and 6. The ribholder 18 is adapted to slide vertically along the umbrella pole 20 in response to operation of a hand crank 28, or other pulley means attached to the ribholder runner notch 18. Typically, for garden umbrellas, the pole 20 extends through a table top, not shown, and is supported at its lower end by a heavy base or footing member, not shown.

The partial top canopy 12 is covered at the top 30 of the umbrella pole 20 by a finish material 32, shown in FIGS. 1,4 and 6, encircling the pole 20. The top canopy 12 has an outer periphery 34 with an edge binding, not shown. The underside main canopy 22, according to the embodiment shown in FIG. 2, 5 and 6, covers all of the stretcher ribs 16 and is secured at the underside of such stretcher ribs 16 by spring clips 24. Here, the underside main canopy 22 acts to deflect the underside winds, as shown by the arrows 50 in FIG. 2, so that the wind can not reach the central top pivot point of the umbrella canopy, under the top 30 and otherwise lift and possibly damage the umbrella. The configuration of the underside main canopy 22 is designed to provide a wind deflector which reduces the lift effect of wind against the bottom of the umbrella. Thus, the embodiment of FIGS. 1–6 provides both a structurally stable structure by its top partial canopy 12, underside main canopy 22, the rib sleeves 48 and their interconnections therebetween, as well as providing an advantageous wind venting and wind deflection configuration. This assists in preventing flexing, bending and snapping due to the high stresses of strong winds against the umbrella and canopies.

FIGS. 7 through 10 show another embodiment of the invention incorporating a partial top canopy 60, similar to the canopy 12 shown in FIGS. 1–6, together with an underside outer canopy 62 that is open in its central portion while it extends in a ring around the umbrella rib frame such that the outer canopy 62 covers only the outer portion of the canopy ribs. Specifically, the partial top canopy 60, extends from the umbrella pole 80 out to a central portion of canopy ribs 72 where such canopy 60 is secured to the ribs 72 by screws 70. The partial top canopy has an edge binding 64, shown in detail in FIG. 10. The rib frame structure shown herein, for example, is a wood frame market umbrella rib frame, including such wood canopy support ribs 72 which are pivotally attached to a ribholder at the top of pole 80 and are further pivotally connected to stretcher ribs 74 by pivot pins 76 located in the center portion of each rib 72. The stretcher ribs 74 are also pivotally connected at their other end to a conventional ribholder runner notch 78 which is operated by a pulley cord system to slide up and down the umbrella pole 80. The underside outer canopy 62 is totally supported on the outer end of the canopy ribs 72, between the pivot pin 76 of stretcher ribs 74 and the outer end of each canopy rib 72, by means of rib sleeves 82 formed on the underside outer canopy 62. More particularly, the underside outer canopy 62 comprises, in the embodiment shown in FIGS. 7–10, eight(8) panels of canopy fabric material which are joined together along bottom seams 86 by stitching, shown in FIG. 10, with the canopy material extending beyond the seams 86 to form the rib sleeves 82 for receiving therein the outer ends of ribs 72. A top seam 84 is made along the top of the rib sleeve 82 and at an end cap of the sleeve where the end of the canopy rib 72 terminates. Also, the underside outer canopy 62 is sewn along its inner diameter edge by a hem or stitch 68, and along its outer diameter edge by a hem or stitch 66.

It is again pointed out, as in the above described embodiment of FIGS. 1–6, that the underside outer canopy 62 is secured to and extends along the bottom of the ribs 72. The canopy sleeve formed on each rib, and the attachment of the partial top canopy 60 and the underside outer canopy 62, respectively above and below the support ribs 72 at the rib sleeves 86, forms a passage or openings between such canopies to assure the adequate venting of air, indicated in FIG. 10 by arrows 88 and 90, into and out of the underside of the umbrella. One advantage provided by securing the underside outer canopy 62 and the rib sleeves 86 such that the canopy hangs from the ribs as opposed to sitting on top of such ribs 72 is that the hanging canopy creates a deep, permanent vent space with the edge 64 and bottom of the top canopy 60 which can receive crosswinds and updrafts therethrough. These deep vents, or well defined passages are formed with substantial height provided by the height of the stretcher ribs 72, generally ⅝ to ¾ inch high for the wooden ribbed "Market Umbrella" shown, in addition to the thickness of the rib sleeves 82, such that the passages may be one to two inches high and as wide as the spacing between adjacent canopy ribs. The passages are constantly open to permit adequate, deep venting of wind over substantially 360 degrees of the umbrella.

Figure 8:
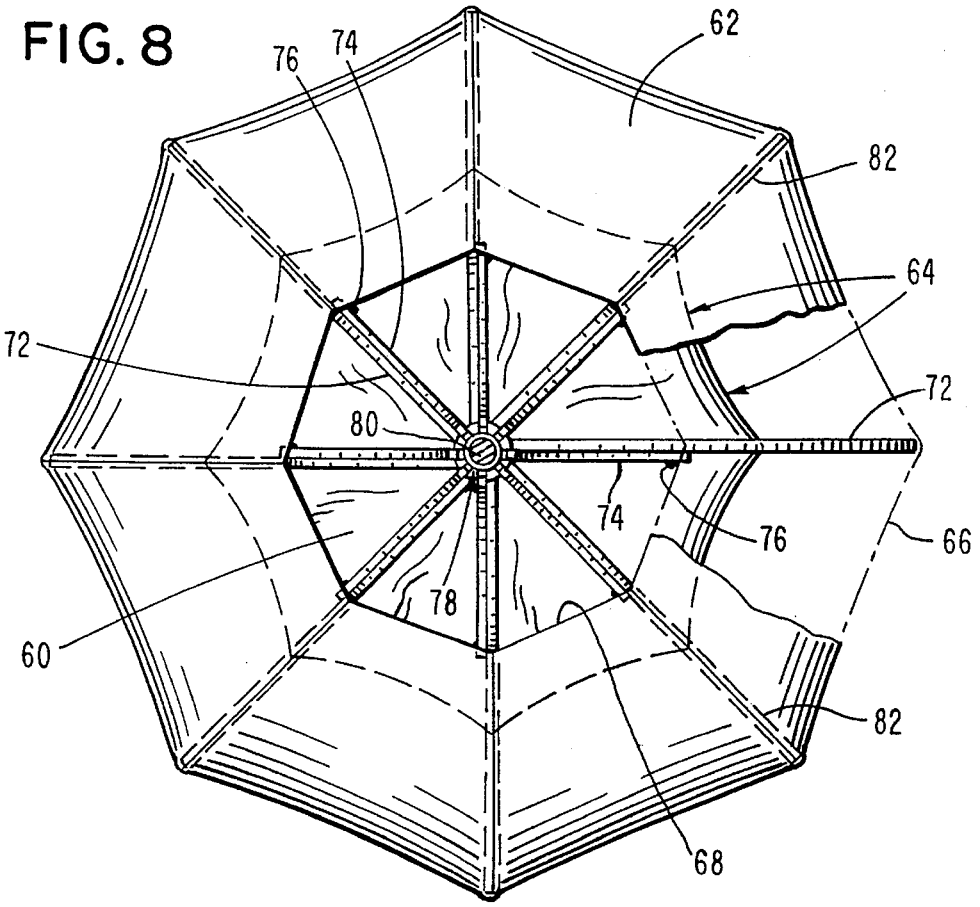
FIG. 8 is a bottom view of the umbrella shown in FIG. 7, showing the center opening of the underside main canopy.
Figure 9:
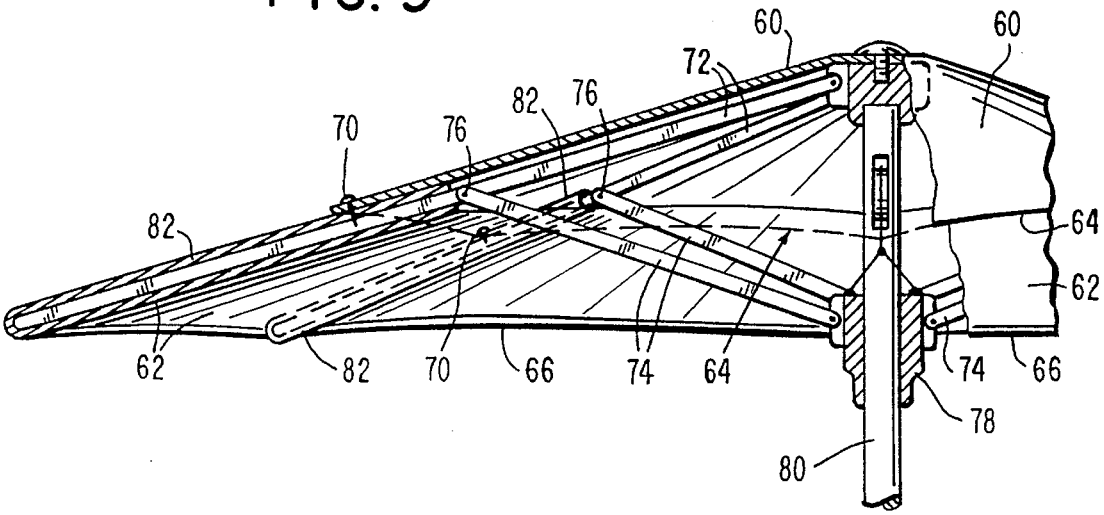
FIG. 9 is a side view, of the umbrella shown in FIG. 7, taken partially in section to show the relative positions of the partial top canopy and the underside main canopy above and below the ribs and the rib sleeves.
Figure 10:
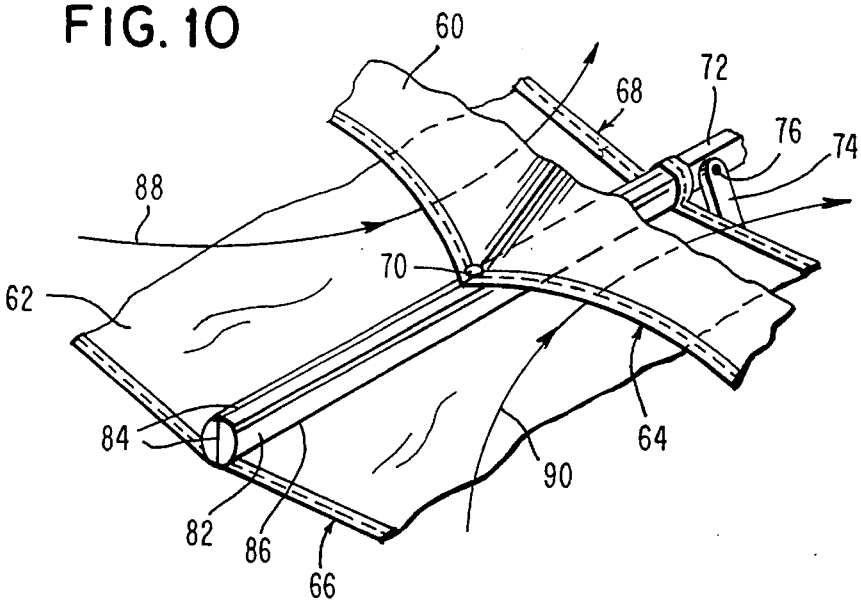
FIG. 10 is a cutaway view of a portion of the umbrella taken from FIG. 7 as indicated, showing the special stitch and seam arrangement of the partial top canopy at the top of the ribs and the stitching of the underside main canopy at the bottom of the ribs to form the vent openings defined by the passage between the adjacent ribs and the top canopy and the underside main canopy.

The umbrella shown in the FIGS. 7–10 provides further venting through the center opening in the underside outer canopy 62, more clearly shown in FIG. 8 as the center area within the inner diameter edge and hem 68. Here, the wind, indicated by arrows 88 and 90 in FIG. 10, can pass through the space formed between the partial top canopy and the underside outer canopy, as well as through the center opening in the outer canopy 62. This large open area provides an effective deflection and release for wind updrafts so they do not lift and possibly damage the umbrella. Also, the umbrella according to the embodiment shown in FIGS. 7–10 possesses significant structural strength, through its arrangement of the partial top canopy 60, the underside outer canopy and the canopy rib and rib sleeve in a double or tandem canopy link between adjacent canopy ribs, thereby minimizing any significant mechanical action of the ribs shifting from side to side in response to winds.

While the invention has been described above with respect to its preferred embodiments, it should be understood that other forms and embodiments may be made without departing from the spirit and scope of the present invention.

What is claimed is:

1. In an umbrella having an umbrella pole, frame support ribs including canopy cover ribs having an upper side and an underside and stretcher ribs, said canopy cover ribs being pivotally connected to said stretcher ribs for opening and closing said umbrella, said canopy cover ribs having upper ends pivotally connected to said umbrella pole at a top portion thereof, each of said canopy cover ribs having a cross-section with a substantional thickness between a top and a bottom and a lower end with an end tip portion and a middle portion between said upper end and said lower end, a ribholder connected to one end of each of said stretcher ribs and encircling said umbrella pole and adapted for slidable movement along said umbrella pole for extending and retracting said frame support ribs for respectively opening and closing said umbrella, and canopy cover means for covering said canopy cover ribs, the improvement of which comprises:

(a) said canopy cover means including a partial top canopy located on said upper side of said canopy cover ribs and extending from said upper end out to said middle portion of each of said canopy cover ribs for partially covering said canopy cover ribs, and an underside outer canopy having a general ring shape with an opening in the center; said underside outer canopy being secured to said underside of said canopy cover ribs and extending between said middle portion and said end tip portion of each of said canopy cover ribs;

(b) canopy cover attachment means for securing said underside outer canopy to said underside of said canopy cover ribs, said canopy cover attachment means including canopy rib sleeves formed on the top side of said underside outer canopy and adapted for receiving therein each of said canopy cover ribs between their said middle portions and said end tip portions thereof, said underside outer canopy comprising individual panels made of canopy material and extending between each adjacent canopy rib sleeve, said canopy panels being sewn together along a line along the bottoms of each canopy rib sleeve and canopy cover rib to form said underside outer canopy extending alone the bottom of said canopy rib sleeves and said canopy cover ribs, and (c) means for securing said partial top canopy to said middle portion of each canopy cover rib at said upper side thereof, whereby a defined, constantly open air vent opening is formed between said partial top canopy and said underside outer canopy, and between said adjacent canopy cover ribs for venting crosswind through said air vent openings;

whereby said connection of said partial rod canopy to said upper side of each canopy rib and said underside outer canopy to said bottom of each rib sleeve forms a double canopy link and constantly open vent passages extending between adjacent canopy ribs which extends substantially around the umbrella.

2. An umbrella as recited in claim 1, wherein said canopy cover ribs are pivotally connected to said stretcher ribs at a pivot, and said underside outer canopy and said canopy rib sleeves extend radially from said pivot point to said lower ends of said canopy ribs.

3. An umbrella as recited in claim 1, wherein said rib sleeves include an end cap at the end where said canopy cover rib terminates.

4. An umbrella as recited in claim 1, wherein said means for securing said partial top canopy to each said canopy cover rib comprises a clip clamped around an outer end portion of said partial top canopy, said rib sleeve and said canopy cover rib.

5. An umbrella as recited in claim 1, wherein said means for securing said partial top canopy to each said canopy cover rib comprises stitches sewn between said partial top canopy and said rib sleeve.

6. In an umbrella having an umbrella pole, frame support ribs including canopy cover ribs having an upper side and an underside and stretcher ribs, said canopy cover ribs being pivotally connected to said stretcher ribs for opening and closing said umbrella, said canopy cover ribs having upper ends pivotally connected to said umbrella pole at a top portion thereof, each of said canopy cover ribs having a cross-section with a substantional thickness between a top and a bottom and a lower end with an end tip portion and a middle portion between said upper end and said lower end and, a ribholder runner connected to one end of each of said stretcher ribs and encircling said umbrella pole and adapted for slidable movement along said umbrella pole for extending and retracting said frame support ribs for respectively opening and closing said umbrella, and canopy cover means for covering said canopy cover ribs, the improvement of which comprises:

(a) said canopy cover means including a partial top canopy located on said upper side of said canopy cover ribs and extending from said upper end out to said middle portion of each of said canopy cover ribs for partially covering said canopy cover ribs, and an underside outer canopy covering said canopy cover ribs and said stretcher ribs and being secured to said underside of said canopy cover ribs and said stretcher ribs and extending between said ribholder runner and said end tip portion of each of said canopy cover ribs;

(b) canopy cover attachment means for securing said underside outer canopy to said underside of said canopy cover ribs, said canopy cover attachment means including canopy rib sleeves formed on the top side of said underside outer canopy and adapted for receiving therein each of said canopy cover ribs between their said middle portions and said end tip portions thereof, said underside outer canopy comprising individual panels made of canopy material and extending between each adjacent canopy rib sleeve, said canopy panels being sewn together along a line along the bottoms of each canopy rib sleeve and canopy cover rib to form said underside outer canopy extending along the bottom of said canopy rib sleeves and said canopy cover ribs; and (c) means for securing said partial top canopy to said middle whereby a defined, constantly open air vent opening is formed portion of each canopy cover rib at said upper side thereof, between said partial top canopy and said underside outer canopy, and between said adjacent canopy cover ribs for venting crosswind through said air vent openings;

whereby said connection of said partial top canopy to said upper side of each canopy rib and said underside outer canopy to said bottom of each rib sleeve forms a double canopy link and constantly open vent passages extending between adjacent canopy ribs which extends substantially around the umbrella.

7. An umbrella as recited in claim 6, wherein said canopy cover ribs are pivotally connected to said stretcher ribs at a pivot point, and said underside outer canopy and said canopy rib sleeves extend radially from said pivot point to said lower ends of said canopy ribs.

8. An umbrella as recited in claim 6, wherein said rib sleeves include an end cap at the end where said canopy cover rib terminates.

9. An umbrella as recited in claim 6, wherein said means for securing said partial top canopy to each said canopy cover rib comprises screw means.

10. An umbrella as recited in claim 6, wherein said means for securing said partial top canopy to each said canopy cover rib comprises stitches sewn between said partial top canopy and said rib sleeve.

* * * * *